US008714909B2

(12) United States Patent
Propheter-Hinckley

(10) Patent No.: US 8,714,909 B2
(45) Date of Patent: May 6, 2014

(54) PLATFORM WITH COOLING CIRCUIT

(75) Inventor: Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 449 days.

(21) Appl. No.: 12/975,416

(22) Filed: Dec. 22, 2010

(65) Prior Publication Data

US 2012/0163975 A1 Jun. 28, 2012

(51) Int. Cl.
*F01D 5/18* (2006.01)

(52) U.S. Cl.
USPC ..... 415/115; 416/97 R

(58) Field of Classification Search
USPC ..... 415/115, 191, 211.2; 29/889.2, 889.7, 29/889.71, 889.72, 889.721, 889.722, 29/527.1, 527.5
See application file for complete search history.

(56) References Cited

U.S. PATENT DOCUMENTS

| | | | | |
|---|---|---|---|---|
| 5,350,277 | A | 9/1994 | Jacala et al. | |
| 2009/0028692 | A1* | 1/2009 | Surace et al. | 415/115 |
| 2011/0135446 | A1* | 6/2011 | Dube et al. | 415/115 |

FOREIGN PATENT DOCUMENTS

| | | | |
|---|---|---|---|
| EP | 1726785 | A2 | 11/2006 |
| EP | 2131011 | A2 | 12/2009 |
| GB | 1553701 | A | 9/1979 |
| WO | 2010112360 | A1 | 10/2010 |

* cited by examiner

*Primary Examiner* — Edward Look
*Assistant Examiner* — Juan G Flores
(74) *Attorney, Agent, or Firm* — Bachman & LaPointe, P.C.

(57) ABSTRACT

A turbine engine component has an airfoil portion, which airfoil portion is bounded by a platform at one end. The platform has an as-cast open cavity bordered by at least one as-cast landing. A plate is welded to the at least one as-cast landing to cover and close the as-cast open cavity. A process for forming the turbine engine component is described.

16 Claims, 10 Drawing Sheets

PLATFORM WITH COOLING CIRCUIT

STATEMENT OF GOVERNMENT INTEREST

The subject matter described herein was made with government support under Contract No. N00019-02-C-3003 award by the Department of the Navy. The government of the United States of America may have rights to the subject matter described herein.

BACKGROUND

The present disclosure is directed to a turbine engine component having a platform with a cooling circuit and a process for forming same.

Currently, a high level of cooling technology for turbine airfoil platforms involves the placement of a miniature core within the wall of the platform. This core is suspended between the hot side of the wall, or gas path, and the cold side of the wall. This technology pulls air from the cold non-gas path side through a number of cooling fins, i.e. trip strips protruding from the gas path side, and pins or pedestals spanning between the hot and cold walls. The air is evacuated out onto the gas path surface where the air spreads out on the surface to create a thin film of cooler air to help further protect the surface from hot gas path air.

FIG. 1 illustrates a turbine vane 10 with a platform cavity 12 which has been formed using a core 14 (see FIG. 2). The vane has outer 16 and inner 18 platforms, with an airfoil 20 spanning there between. The airfoil 20 has multiple internal cavities 22 and 24 and has a pressure or concave side 26 and a suction or convex side 28. The outer and inner platforms 16 and 18 respectively both have a hot gas path side 30 and a cooler non-gas path side 32. The outer platform 16 has a platform cavity 12 whose entrance 34 allows the cooler air on the non-gas path side 32 to enter the cavity 12 and flow through the cavity 12 to exit onto the hot gas path side 30 of the outer platform 16 where this air creates a thin film of cooler air on the surface which protects that surface from the hot gas path air.

FIG. 2 shows a cut away of the outer platform 16 prior to the cores 36 and 38 which form the airfoil cavities 22 and 24 being leached out. Also shown in the figure is the core 14, prior to it being leached out. The core 14 has holes 40 of varying shape in it that helps create turbulent air flow within the cavity and increase surface area thereby increasing the heat transfer capability of the air.

FIG. 3 shows a cut away of the outer platform 16 after the cores 36 ad 38 have been leached out of the airfoil to form the airfoil cavities 22 and 24. The figure also shows the cavity 12 which is formed by the core 14 after it has been leached out. When the platform core 14 is leached out, the holes 40 in the core 14 leave a three dimensional mirror solid behind in the form of a plurality of pedestals 42. Also trenches in the core 14 create trip strips 44 to further increase the turbulence of the air and increase the surface area, thereby increasing heat transfer.

FIG. 4 shows a close up of the cut away of the cavity 12 in the outer platform 16 and shows the arduous paths 46 the air must travel from the entrance 34 of the cavity to the exit 48 on the gas path side of the platform.

This technology works extraordinarily well; however, it is complicated to implement in turbine vanes. It requires a four piece wax assembly for a turbine doublet which is not production friendly. The technology is expensive.

SUMMARY

An inexpensive approach to forming a turbine engine component with a platform cavity is described herein.

In accordance with the present disclosure, a turbine engine component broadly comprises an airfoil portion, said airfoil portion being bounded by a platform at one end, said platform having an as-cast open cavity bordered by at least one as-cast landing, and a plate welded to said at least one as-cast landing to cover said as-cast open cavity.

Further in accordance with the present disclosure, there is provided a process for forming a turbine engine component comprising the steps of casting a turbine engine component having an airfoil portion with a pressure side and a suction side and a platform with an open cavity and a landing positioned on a periphery of said cavity, positioning a plate over an opening in said open cavity, and welding said plate to said landing to close said cavity.

Other details of the platform with cooling circuit are set forth in the following detailed description in which like reference numerals depict like elements.

DETAILED DESCRIPTION OF THE PREFERRED EMBODIMENT(S)

Figure 1:
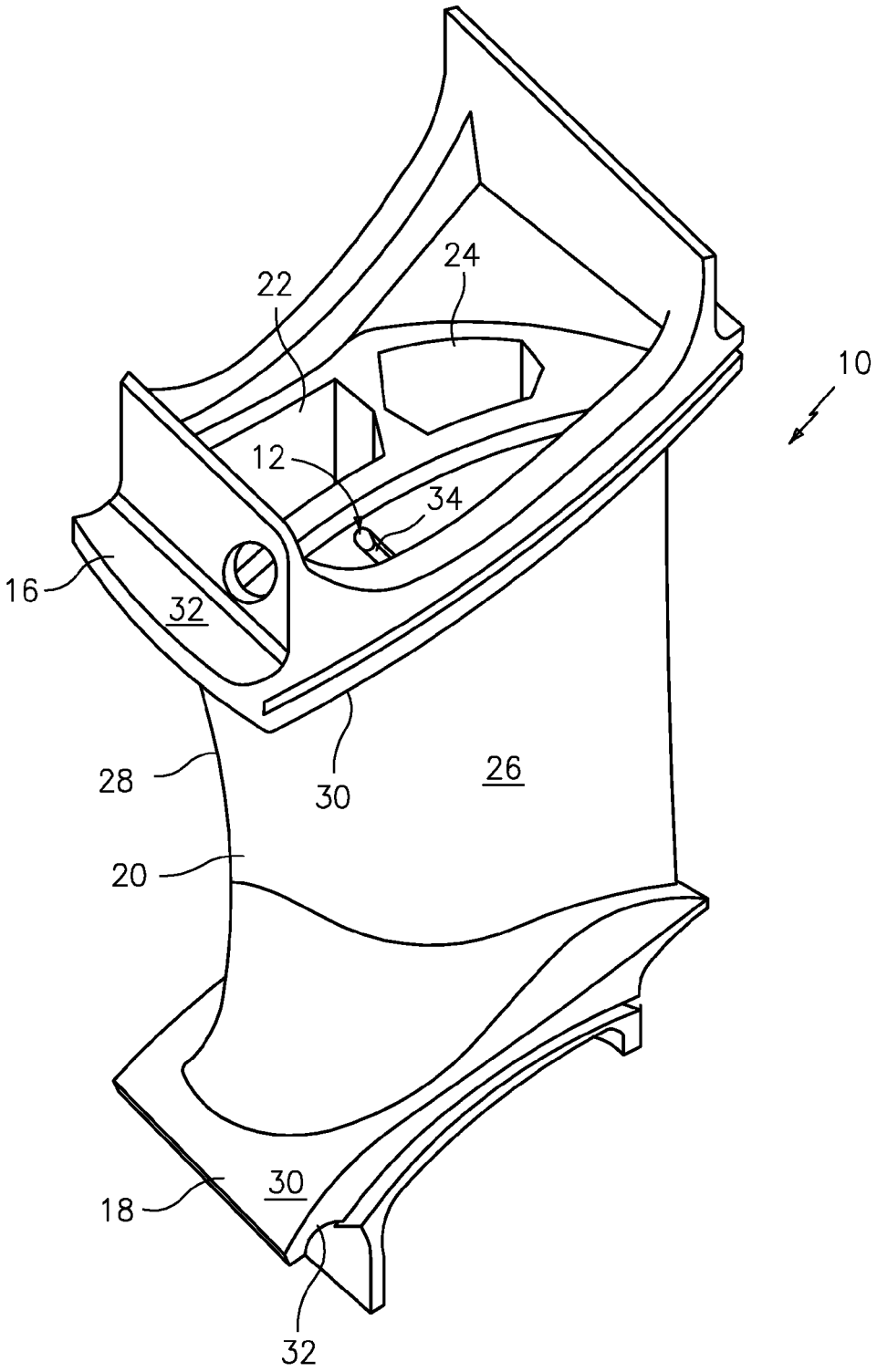
FIG. 1 (PRIOR ART)
FIG. 1 illustrates a turbine vane with a cast in platform cavity.
Figure 2:
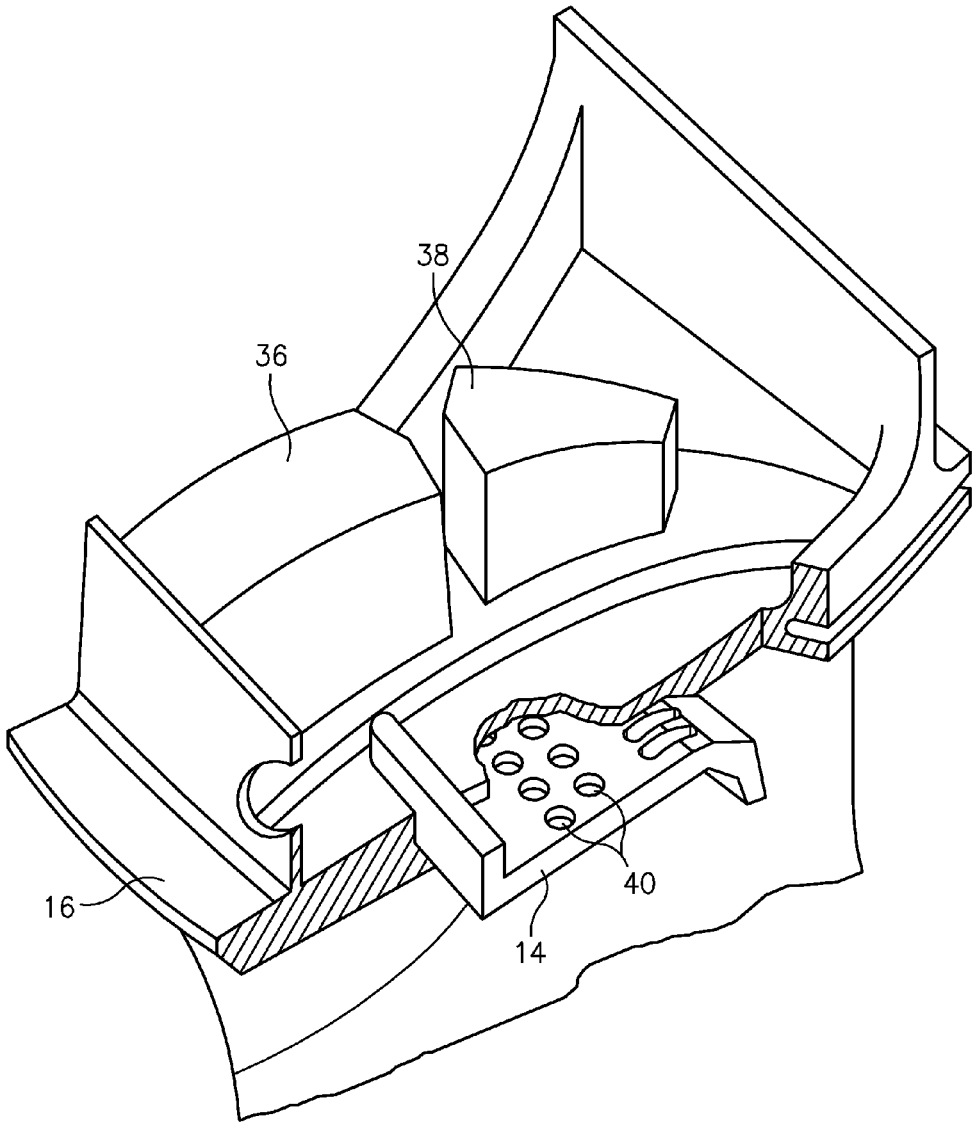
FIG. 2 (PRIOR ART)
FIG. 2 illustrates a section view of an outer platform of the turbine vane of FIG. 1 with the casting cores being present.
Figure 3:
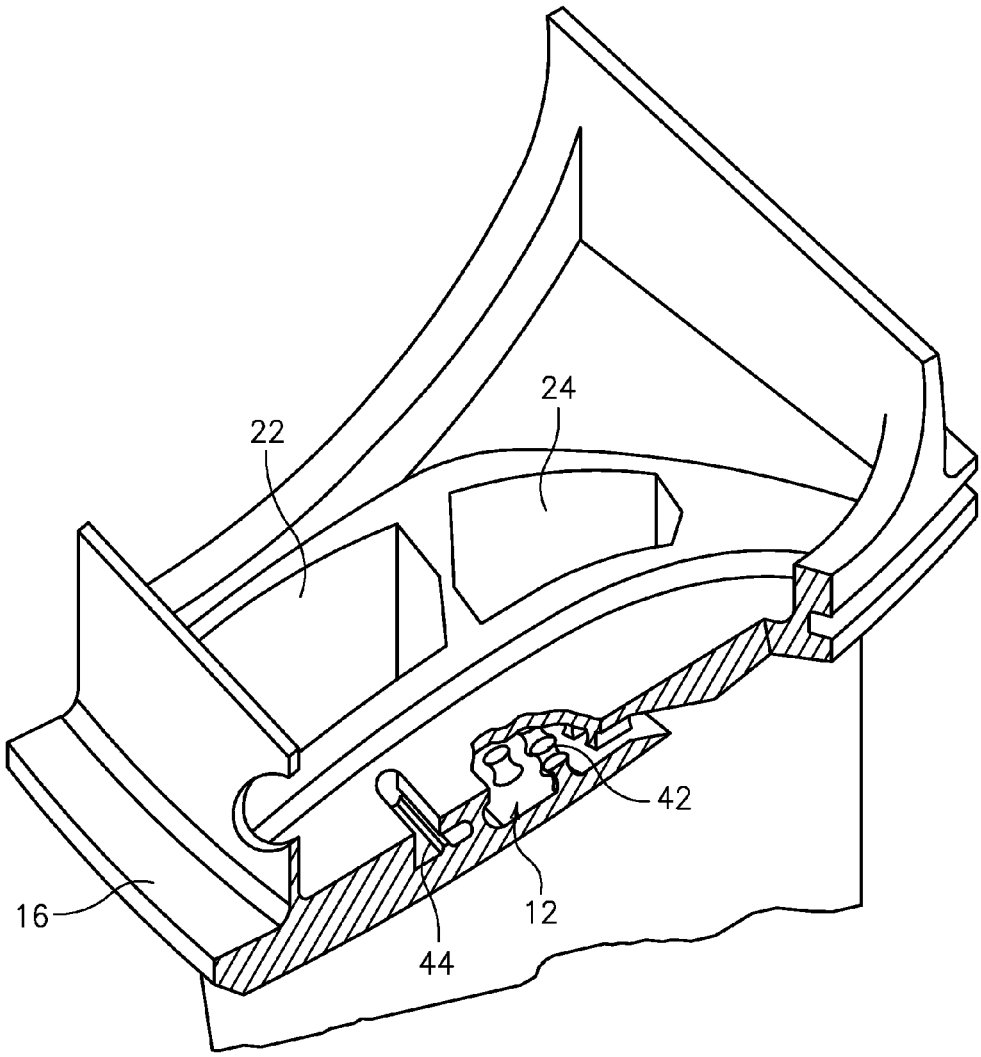
FIG. 3 (PRIOR ART)
FIG. 3 illustrates a section view of the outer platform of FIG. 1 with the casting cores removed.
Figure 4:
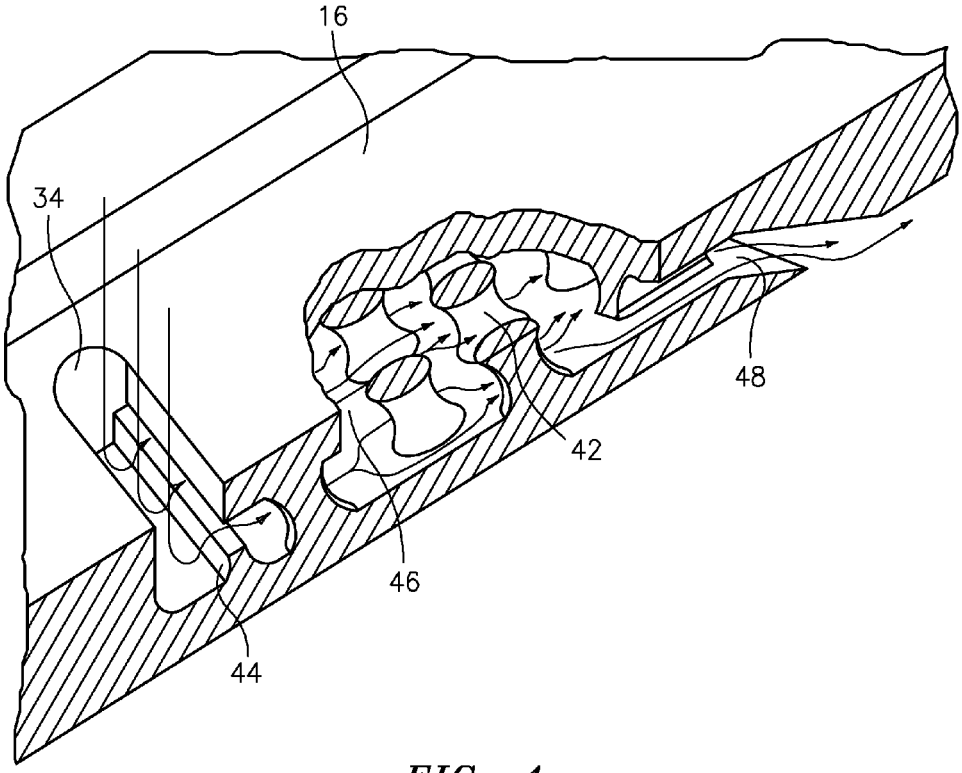
FIG. 4 (PRIOR ART)
FIG. 4 is an enlarged view of the outer platform cavity of FIG. 1.
Figure 5:
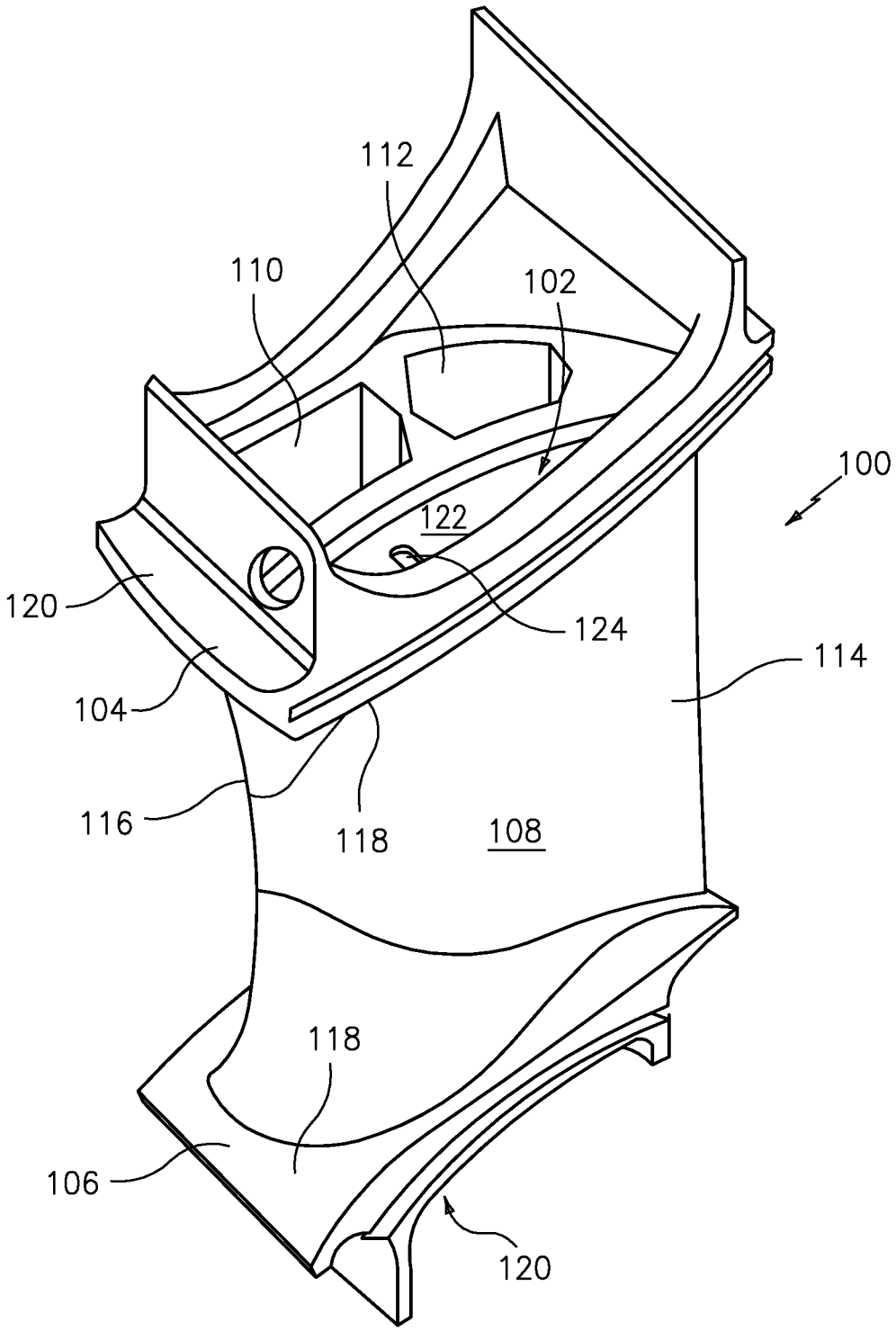
FIG. 5 illustrates a turbine vane with a covered platform cavity in accordance with the present disclosure.

Referring now to FIG. 5, there is shown a turbine vane 100 with a covered platform cavity 102. The vane 100 has outer 104 and inner 106 platforms with an airfoil 108 spanning between them. The airfoil 108 has multiple internal cavities 110 and 112 and has both a pressure or concave side 114 and a suction or convex side 116. The outer and inner platforms 104 and 106 respectively have both a hot gas path side 118 and a cooler non-gas path side 120. The outer platform 104 has a platform cavity 102 which is formed by welding a plate 122 onto the vane 100. The entrance 124 to the cavity 102 is a hole extending through the plate 122. This hole allows the cooler air on the non-gas path side 120 to enter the platform cavity 102 and flow through the cavity 102 to exit onto the hot gas path side 118 of the outer platform 104 where this air creates a thin film of cooler air on the surface which protects that surface from the hot gas path air.

Figure 6:
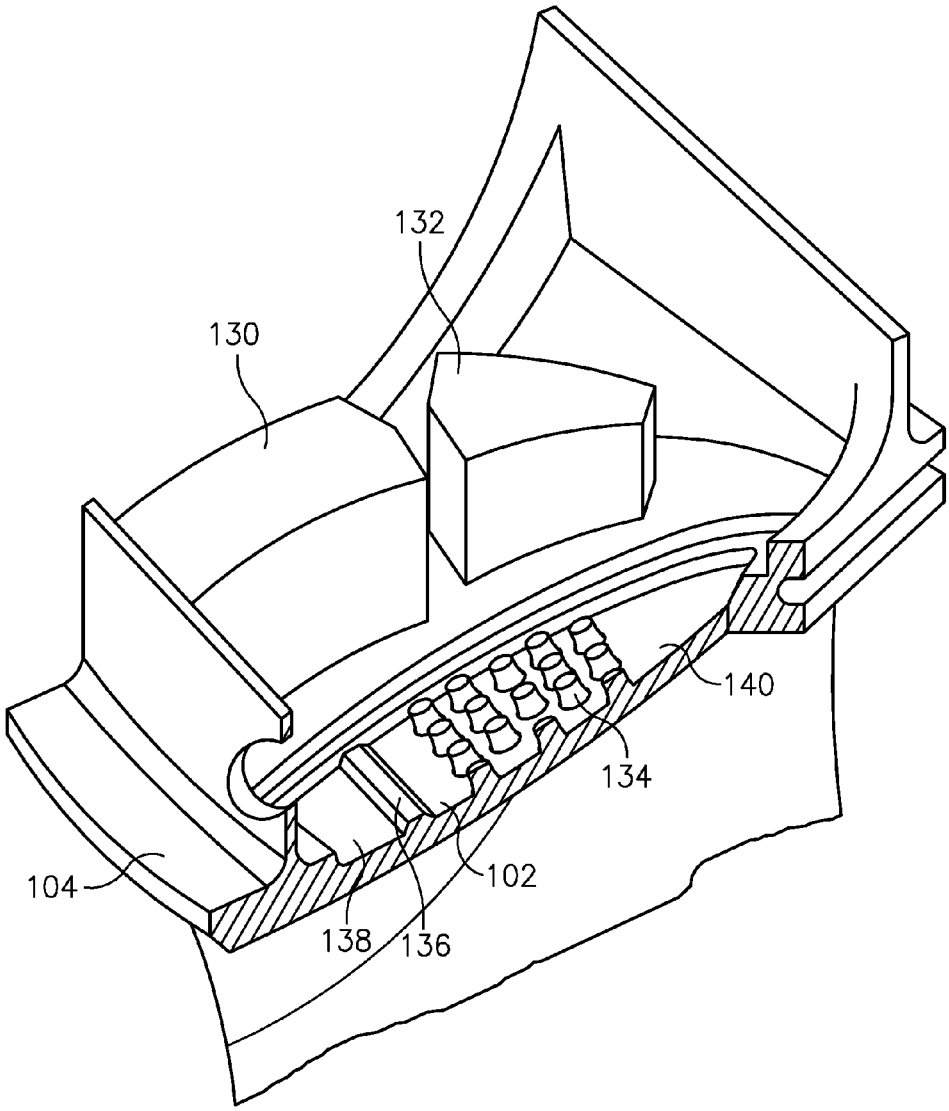
FIG. 6 is a sectional view of the outer platform prior to removal of the cores for forming internal cavities within the airfoil portion.

FIG. 6 shows a cut away of the outer platform 104 prior to the cores 130 and 132 which form the internal cavities 110 and 112 being leached out. The figure also shows the as-cast, open platform cavity 102 prior to having the cover or plate 122 being welded on. The as-cast platform cavity 102 may be located in proximity to the internal cavities 110 and 112 and adjacent the pressure side 114 of the airfoil 108. The open platform cavity 102 includes a plurality of as-cast, integrally formed protuberances 134 and at least one as-cast, integrally formed trip strip 136, which when air is run from one end of the cavity 102 to the other will increase air turbulence and surface area, thereby cooling the platform 104. The as cast platform 104 also includes an entrance area 138 and an exit area 140 which is devoid of any such protuberances. The protuberances 134 can take the form of circular or oblong conics.

Figure 7:
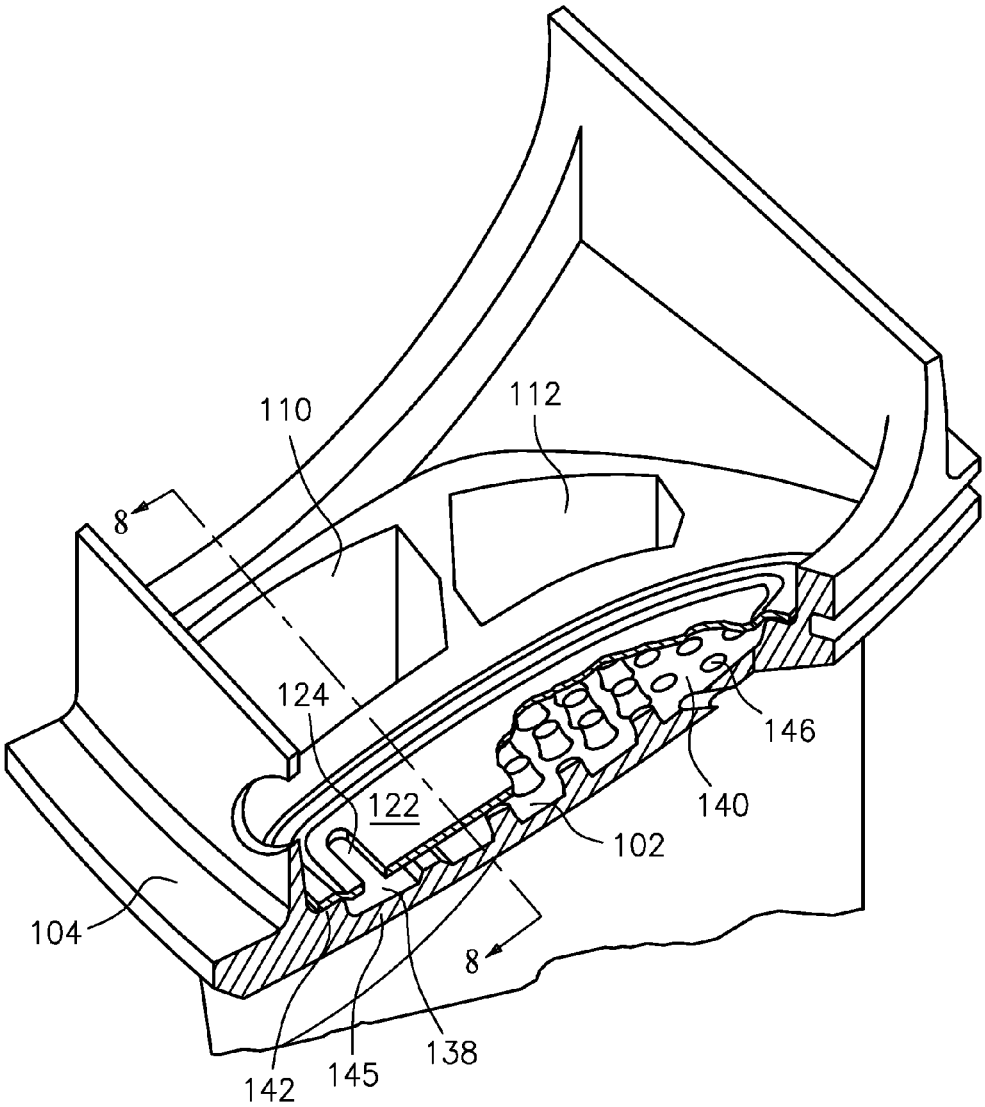
FIG. 7 is a sectional view of the outer platform after the cores have been removed.
Figure 8:
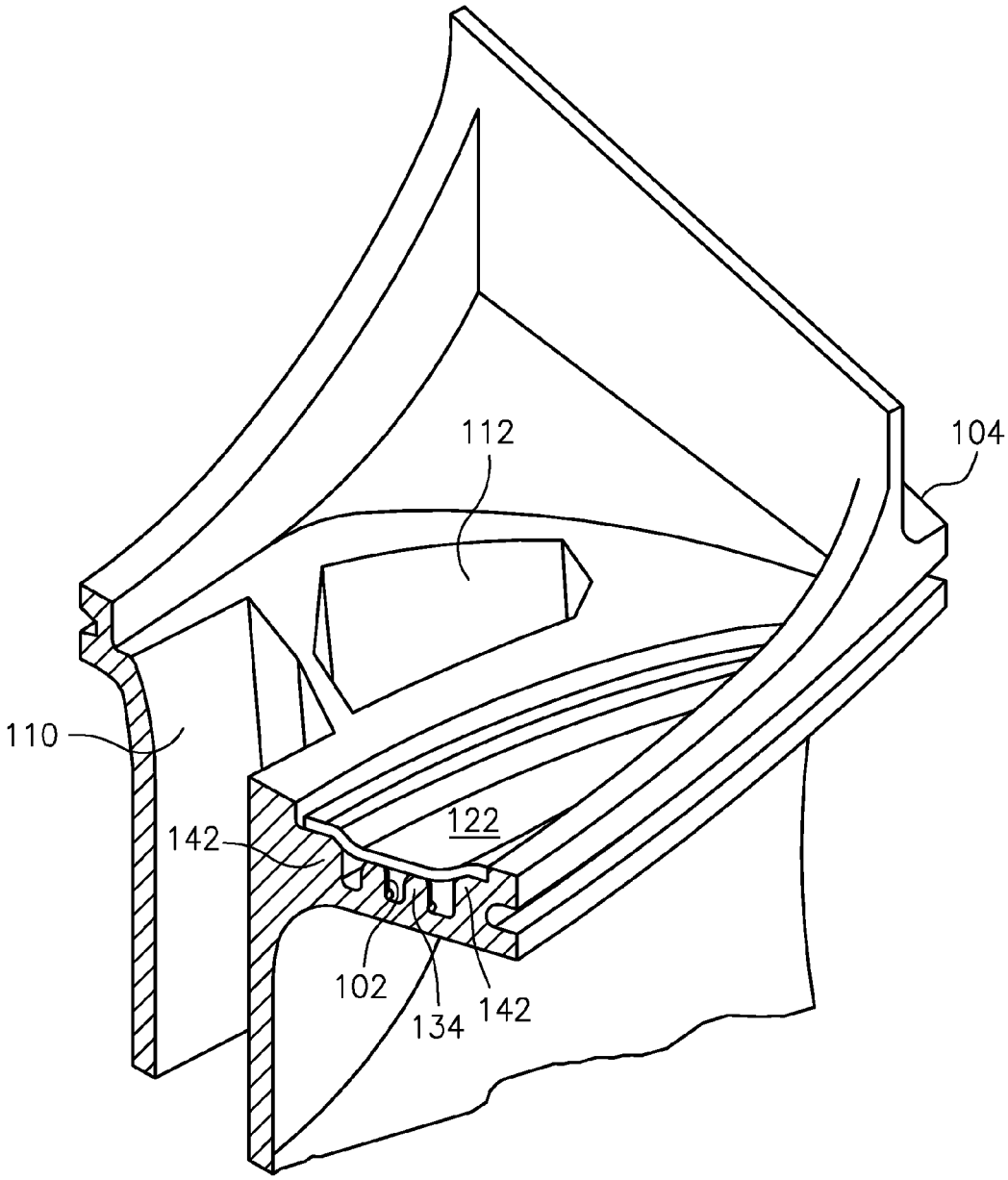
FIG. 8 is a sectional view taken along lines 8-8 in FIG. 7.

FIGS. 7 and 8 show cut away views of the outer platform 104 after the airfoil cores 130 and 132 have been leached out of the airfoil to form the airfoil cavities 110 and 112. The figures also show the cavity 102 formed by the casting and the welded on plate 122. The welded plate 122 is welded onto the as-cast landing 142 which may be positioned on a periphery of the cavity 102 and which circumscribes the cavity 102. As can be seen in FIG. 8, the plate 122 when welded into position rests on the protrusions 134 to create flow channels through the protrusions. The plate 122 when welded in position also rests on the landing 142. Any suitable technique known in the art may be used to weld the plate 122 in position and to a wall of the cast platform 104.

Figure 9:
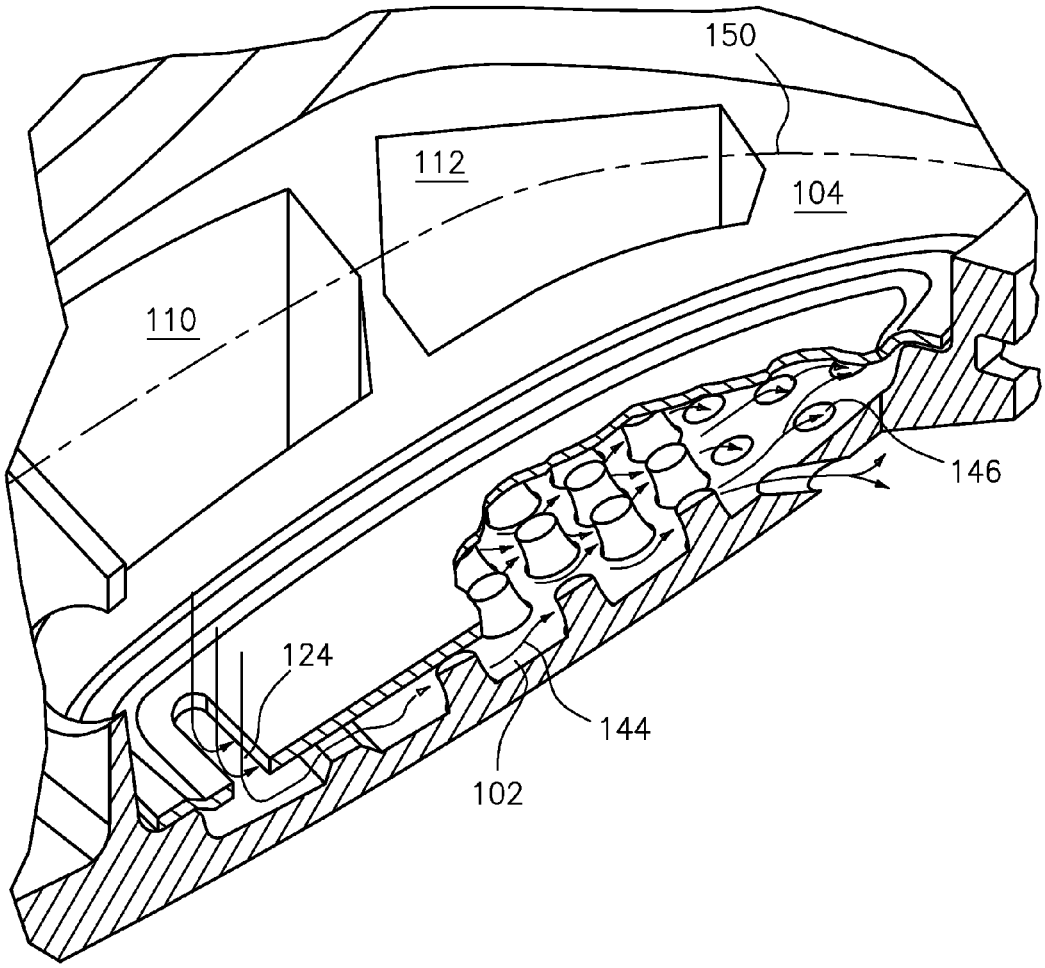
FIG. 9 is an enlarged view of the platform cavity.

The hole 124 in the plate 122 is positioned over an entrance area 138 of the casting 145. The hole 124 allows cooling fluid from the non-hot gas side of the platform 104 to enter the cavity 102. Holes 146 are drilled into or otherwise formed in the exit area 140 of the cavity 102 so that the air can flow out of the cavity 102 into the hot air gas path. FIG. 9 shows the arduous paths 144 the air must travel from the entrance 124 of the cavity to the holes 146 to exit onto the gas path side of the platform 104. It should be noted that the plate 122 does not add any appreciable structural member to the platform 104 as its cored counterpart.

As can be seen from FIG. 9, the airfoil 108 has a chord line 150. The cavity 102 may be located on either the pressure side or the suction side of the chord line 150.

The process for forming the turbine engine component involves positioning the cores 130 and 132 in a mold (not shown). The turbine engine component 100 is then formed by a casting technique wherein molten metal is poured into the mold (not shown). As a result of the casting process and subsequent solidification of the molten metal, there is formed a component 100 having the airfoil 108 with the pressure side 114 and the suction side 116, the platforms 104 and 106, the open cavity 102 in the platform 104, the protrusions 134, the at least one trip strip, 136, the entrance area 138, the exit area 140, and the peripheral landing 142. Following solidification, the cores 130 and 132 may be removed using any suitable technique, such as leaching, known in the art. The plate 122 may then be attached to the outer platform 104 using any suitable welding or brazing technique known in the art. The exit holes 146 may be formed either before or after the plate 122 is installed. The exit holes may be formed using a drilling technique such as EDM.

Figure 10:
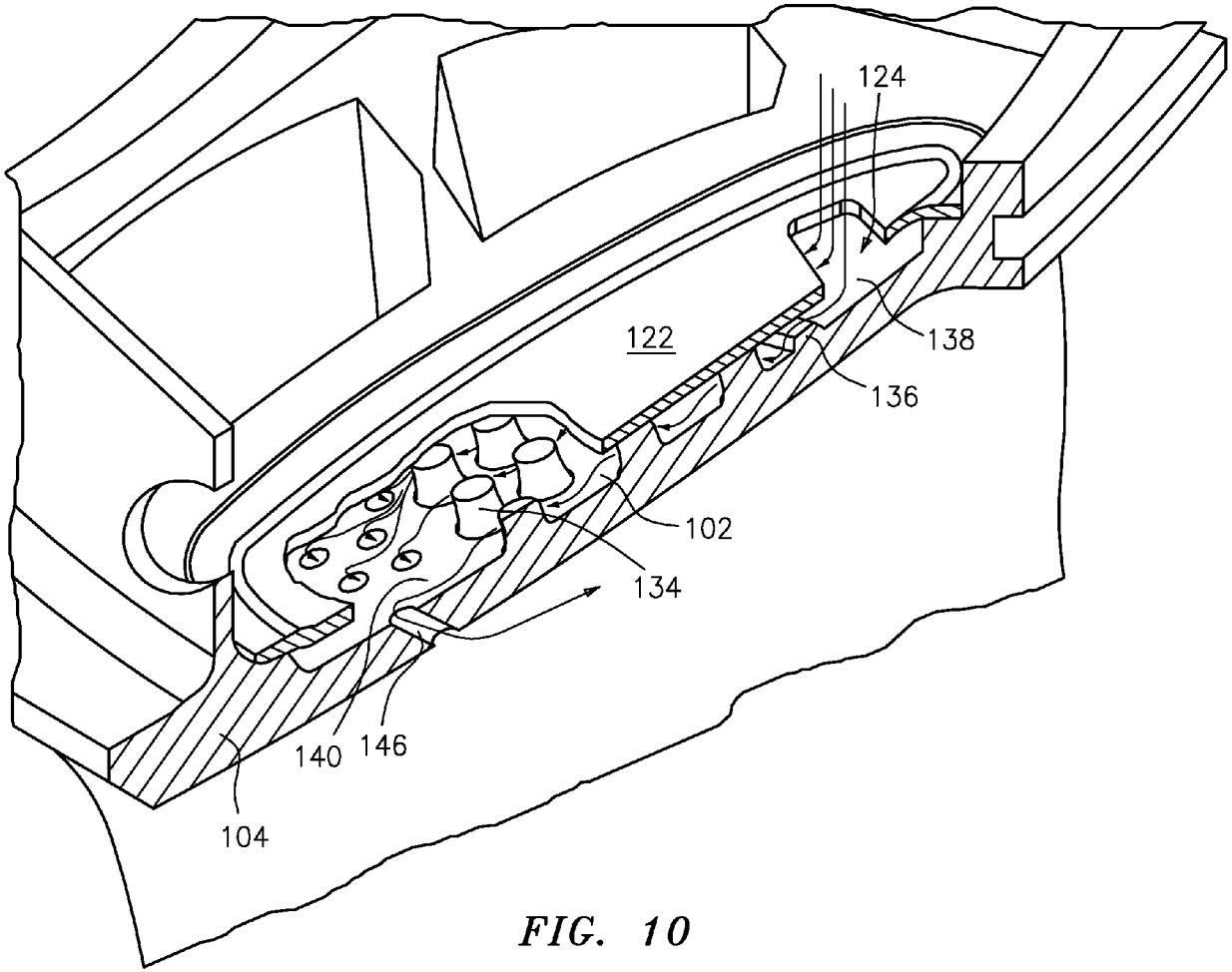
FIG. 10 is a sectional view of an outer platform with a forward flowing cavity.

One significant advantage to the technique described herein is that it is inexpensive. Another advantage is that while the entrance 124 may be located at the leading edge of the cavity 102 and the exit holes 146 may be located at the trailing edge of the cavity 102, it is entirely feasible to reverse the structure as shown in FIG. 10. This means that the same air which is used to cool the back side of the platform 104 flowing forward can be used to create a protective cooling air film on the gas path side flowing aftward over the same region. This reverse flow is not possible using a mini core configuration due to the shape of the exits. The present technique may provide a distinct advantage in areas that can not be cooled by enhanced back side cooling alone.

There has been provided in accordance with the present disclosure a platform with a cooling circuit. While the present disclosure has been made in the context of one or more embodiments, it should be apparent that unforeseen alternatives, modifications, and variations may become apparent to those skilled in the art having read the foregoing description. It is therefore intended to embrace those alternatives, modifications, and variations as fall within the broad scope of the appended claims.

What is claimed is:

1. A turbine engine component comprising:

an airfoil portion;

said airfoil portion being bounded by a platform at one end;

said platform having an as-cast open cavity bordered by at least one as-cast landing;

a plate welded to said at least one as-cast landing to cover said as-cast open cavity; and said cavity having an entrance area and said plate having an opening which overlies said entrance area wherein said opening is in a trailing edge portion of said plate.

2. The turbine engine component of claim 1, further comprising said cavity having an exit area in a trailing edge portion thereof and said exit area having a plurality of holes for directing cooling air over a hot gas path side of said platform.

3. The turbine engine component of claim 1, further comprising said cavity having a plurality of as-cast, integrally formed protuberances.

4. The turbine engine component of claim 1, further comprising said cavity having at least one as-cast, integrally formed trip strip.

5. The turbine engine component of claim 1, wherein said as-cast landing circumscribes said cavity.

6. The turbine engine component of claim 1, wherein said platform is an outer platform and wherein said component has an inner platform and said airfoil portion extends between said inner and outer platforms.

7. The turbine engine component according to claim 1, wherein said airfoil portion has a pressure side, a suction side, and at least one internal cavity and said platform cavity is located in proximity to said at least one internal cavity and adjacent one of said pressure side and said suction side.

8. The turbine engine component of claim 1, further comprising said cavity having an exit area in a leading edge portion thereof and said exit area having a plurality of holes for directing cooling air over a hot gas path side of said platform.

9. A process for forming a turbine engine component comprising the steps of:

casting a turbine engine component having an airfoil portion with a pressure side and a suction side and a platform with an open cavity and a landing positioned on a periphery of said cavity;

positioning a plate over an opening in said open cavity, wherein said positioning step comprises positioning said plate with an opening over an entrance area in said open cavity wherein said opening is in a trailing edge portion of said plate; and welding said plate to said landing to close said cavity.

10. The process of claim 9, wherein said casting step comprises casting a plurality of protuberances positioned within said cavity.

11. The process of claim 9, wherein said casting step comprises forming at least one trip strip in said cavity.

12. The process of claim 9, further comprising forming a plurality of cooling fluid exit holes in said cavity.

13. The process of claim 9, wherein said landing circumscribes a periphery of said cavity.

14. The process of claim 9, wherein said airfoil portion has a chord line and said casting step comprises forming said open cavity on one of a pressure side and a suction side of said chord line.

15. The process of claim 9, further comprising forming at least one internal cavity in said airfoil portion using at least one core.

16. A turbine engine component comprising:

an airfoil portion;

said airfoil portion being bounded by a platform at one end;

said platform having an as-cast open cavity bordered by at least one as-cast landing; and a plate welded to said at least one as-cast landing to cover said as-cast open cavity, wherein said cavity having an entrance area and said plate having an opening which overlies said entrance area, said opening is in a trailing edge portion of said plate said cavity having an exit area in a leading edge portion thereof and said exit area having a plurality of holes for directing cooling air over a hot gas path side of said platform.

* * * * *